US005210990A

United States Patent [19]

Kirk, Jr.

[11] Patent Number: 5,210,990

[45] Date of Patent: May 18, 1993

[54] C-CHANNEL CONSTRUCTION MEMBER

[75] Inventor: James D. Kirk, Jr., Elkhart, Ind.

[73] Assignee: Concept Resources Group, Ltd., River Forest, Ill.

[21] Appl. No.: 372,913

[22] Filed: Jun. 28, 1989

[51] Int. Cl.[5] ..... E04B 9/00

[52] U.S. Cl. ..... 52/664; 52/665; 52/481; 52/631

[58] Field of Search ..... 52/631, 664, 665, 481

[56] References Cited

U.S. PATENT DOCUMENTS

| | | | |
|---|---|---|---|
| 1,846,881 | 2/1932 | Lewis | 52/631 |
| 2,505,789 | 5/1950 | Norquist | 62/631 |
| 3,188,773 | 6/1965 | Schneller et al. | 52/243 X |
| 3,305,993 | 2/1967 | Nelsson | 52/481 |
| 4,000,594 | 1/1977 | Kirk, Jr. | 52/241 |
| 4,235,054 | 11/1980 | Cable | 52/481 |
| 4,402,170 | 9/1983 | Seidner | 52/631 |
| 4,704,837 | 11/1987 | Menchetti et al. | 52/631 |
| 4,896,469 | 1/1990 | Wright | 52/481 |

*Primary Examiner*—Henry E. Raduazo
*Attorney, Agent, or Firm*—Speckman & Pauley

[57] ABSTRACT

An elongated C-channel construction member made of a wood composite material. The C-channel has a blank panel with a generally planar panel front and panel back, a top, a bottom and two sides. The panel front has two grooves extending from the top to the bottom of the blank panel. Each groove has a depth approximately equal to a thickness of the blank panel. A flat back support is adhered to the panel back. The flat back support retains the blank panel with the grooves in a sheet form. The two grooves divide the blank panel into a web and two flanges. The flanges fold upward and generally perpendicular to the panel front thus forming the C-channel.

12 Claims, 5 Drawing Sheets

C-CHANNEL CONSTRUCTION MEMBER

BACKGROUND OF THE INVENTION

1. Field of the Invention

A building construction member including a rectangular web with perpendicular flanges extending from one face thereof along opposed edges to form a C-channel shaped construction element which is fabricated from a single piece of reconstituted wood composite panel, such as oriented strand board (OSB).

2. Description of the Prior Art

There is a continuing need for improvements in structural materials particularly those suitable for housing and light commercial/industrial buildings. There is a growing shortage of larger trees from which to make traditional structural and framing lumber. Witness the proliferation of composite and engineered structural wood products over the past 20 years such as roof tresses and various designs of wood I-beams and laminated veneer lumber (LVL) for floor joists, headers and beams. Witness also the shift among major forest products manufacturers from plywood panels, which require large logs for veneer peeling, to reconstituted structural panels such as wafer board and oriented strand board OSB, which are made of wafers and strands of wood fiber made from small parts of large trees or large parts of small trees. In other words, there is a trend to make better use of a shrinking supply of large, mature timber as well as to utilize smaller, younger trees and parts. Wood producers are finding it practical and economical to fabricate structural wood products using small pieces of wood, glue and pressure. It has been the observation of the applicant that not only are structural lumber pieces becoming scarcer and more expensive, but the problems of warping, twisting, racking and inconsistency are becoming more common as quality declines. Lumber that is straight is available but at premium prices.

Another large factor in the lumber market is freight and storage costs. This invention offers improvements in both of these areas.

There have been numerous attempts to use composite wood material structural elements, most of these have been slight variations on the wood I-beam which have been intended for the relatively heavier framing functions of floor and roof construction. Composite timber and metal plate floor joints and roof tresses are quite common. Laminated veneer lumber (LVL) is used for heavy duty components such as beams and headers.

There have been few attempts brought to public attention at utilizing engineered or composite wood components for simple framing lumber such as 2×2, 2×4, and 2×6 for wall construction. Two components have recently attempted to reach into this commodity stud market. One was a smaller composite wood I-beam used in place of 2×6 vertical studs. The other was a solid wood stud machined to I-beam shape for nesting in shipping and attachment. Neither system seems to offer apparent advantages over conventional lumber that would merit the additional fabrication and expense.

SUMMARY OF THE INVENTION

It is one object of this invention to convert flat sheets of commodity wood composite materials such as plywood or oriented strand board, (OSB) into basic structural elements which perform the same function as standard dimension framing lumber commonly known as 2×2, 2×3, 2×4, 2×6, 2×8, 2×10, 2×12 etc.

This invention relates to a building construction member having a rectangular web with perpendicular flanges extending from one face thereof along opposed edges to form a C-channel shaped construction element which can be fabricated in different sizes and strengths and will be suitable for use as framing material for walls, partitions, ceilings, sofets, floors, etc. in housing and light construction. A building construction member according to this invention, will replace standard dimension lumber in many instances for sight built construction as well as in plant industrialized building.

Also disclosed is the blank from which the construction member is fabricated with particular detail of the reconstituted wood composite panel blank from which the C-channel structural element is formed. The American Plywood Association uses a blanket term to cover the various wood panel products used in the building industry and from which the subject of this invention may be fabricated. The term is "structural panel" and it includes panels manufactured from glue and wood fiber in various forms including plywood, medium density fiber board, particle board, wafer board and oriented strand board (OSB). From a strength standpoint, both plywood and OSB are suitable for use as the material for this invention. From a cost standpoint, OSB is more economical.

Also disclosed are connections between the construction members as well as connections to standard building materials such as sheathing, gypsum drywall and interior paneling.

Also disclosed is the use of the construction member as the basic component for more sophisticated composite structural elements such as floor and roof trusses and headers much as conventional dimension lumber is used in such applications.

Also disclosed is the use of the V-grooving miter folding technique for fabricating the engineered lumber system of this invention. This is a technique which has enjoyed widespread use in the furniture and cabinet industries in North America and Europe but which use in the construction industry has been mostly confined as disclosed in U.S. Pat. No. 4,000,594 and U.S. Pat. No. 4,079,553. This invention applies the technique to a basic structural building component with commodity potential.

Also disclosed is the fabrication of a four-sided construction member for special applications such as where greater rigidity in the same cross section or four nailable sides are required. The process is the same with the addition of two V-grooves.

The conversion from a blank panel to a C-channel will be accomplished by cutting the OSB panels into desired blank sizes, sanding the face, attaching either tape or continuous paper laminate to the face. A precision V-groove will be cut equidistant from each long edge of the blank, preferably at a distance of 1 ½ inches, through the back of the blank down to the face paper or tape. A suitable adhesive will be applied in each groove and the blank will be folded into a C-channel shape and held by suitable means until the adhesive or glue has cured. When the C-channel is cured, it may be drilled to provide holes for residential electrical and plumbing conduit much as steel studs are provided with prepunched holes for non-residential construction.

A wood composite C-channel according to this invention can be used in place of conventional dimension lumber in many instances and offers many advantages.

The primary advantage of this invention is greatly improved quality control due to the perfect straightness of the components. Warping and twisting of standard lumber are eliminated.

Labor costs are lower due to easier handling, lighter weight and easy joining systems and the elimination of problems caused by warpage.

Storage requirements are reduced twenty to thirty percent for framing material and overall weight of framing components are reduced twenty-five to forty-five percent. This is of particular interest to industrialized builders as well as lumber distribution operations.

According to this invention, shipping costs are lowered due to the "C" shape and lower weight. The pieces can be nested and fifty percent more studs per truckload can be shipped as compared to similarly sized conventional studs.

The C-channels of this invention will be priced competitively with conventional framing lumber and it will make better use of dwindling timber resources because it is made with reconstituted wood fiber gleaned mainly from smaller pieces of the tree.

Due to its perfect straightness and uniform surface character, panel material such as sheathing, siding, insulation, gypsum board and interior paneling, etc. can be easily attached by any preferred method such as nailing, screwing, gluing or stapling.

Because of the large press sizes for the OSB panels, extra long C-channels can be produced. C-channels in the vicinity of twenty-four to thirty feet long are possible. Long lengths, such as over twelve feet, of conventional dimension lumber are hard to obtain and command a premium price. Furthermore, their straightness is unreliable. Straightness is inherent in the fabrication process of the C-channels of this invention.

BRIEF DESCRIPTION OF THE DRAWINGS

The above mentioned and other features of this invention and the manner of obtaining them will become more apparent and the invention itself will be best understood by reference to the following description of specific embodiments taken in conjunction with the drawings, wherein.

DESCRIPTION OF THE PREFERRED EMBODIMENTS

Figure 1A:
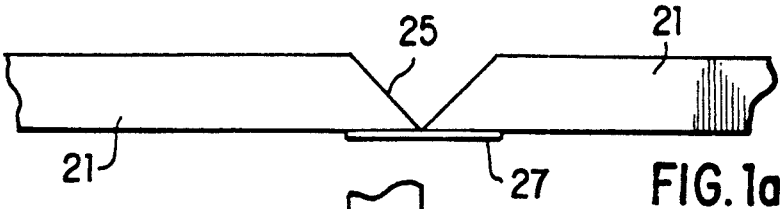
FIGS. 1*a*–2*b* show end views of a V-groove of a C-channel according to one embodiment of this invention.
Figure 1B:
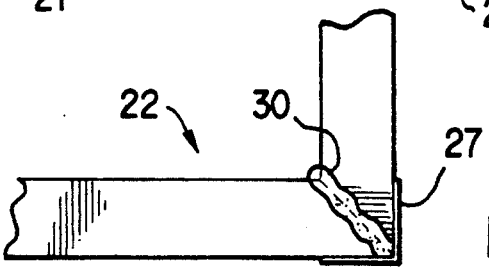

FIGS. 1*a*–2*b* show end views of the V-groove concept of a C-channel of this invention. FIG. 1*a* shows a V-groove 25 backed up by a strip of tape 27 acting as a hinge, this can either be a strip of masking tape or a strip of special V-grooving polypropylene tape which is quite expensive. FIG. 1*b* shows the folded, corner that is adhered with an adhesive 30, such as glue.

Figure 2A:
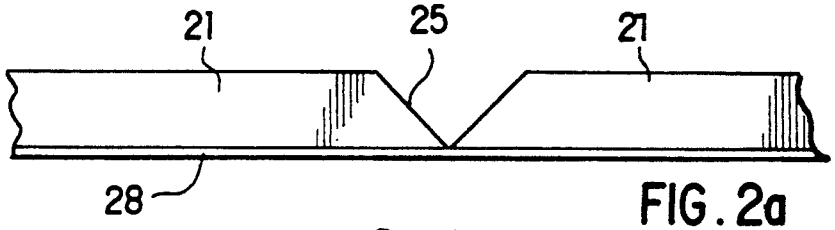
Figure 2B:
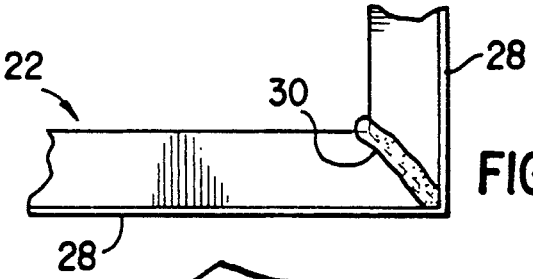

FIG. 2*a* shows an end view of the blank panel 21 with a continuous paper laminate 28 acting as a hinge. In one preferred embodiment, paper laminate 28 is a craft paper that has some flexibility, similar to the paper used in the production of masking tape. It is a very economical material and it will hold the C-channel 22 together until the adhesive 30 or glue forms and it also offers a surface for printing advertising, trademark and patent notifications, and the like on the bottom piece. FIG. 2*b* shows a corner formed from the blank panel 21 with V-groove 25 as shown in FIG. 2*a*.

Figure 3A:
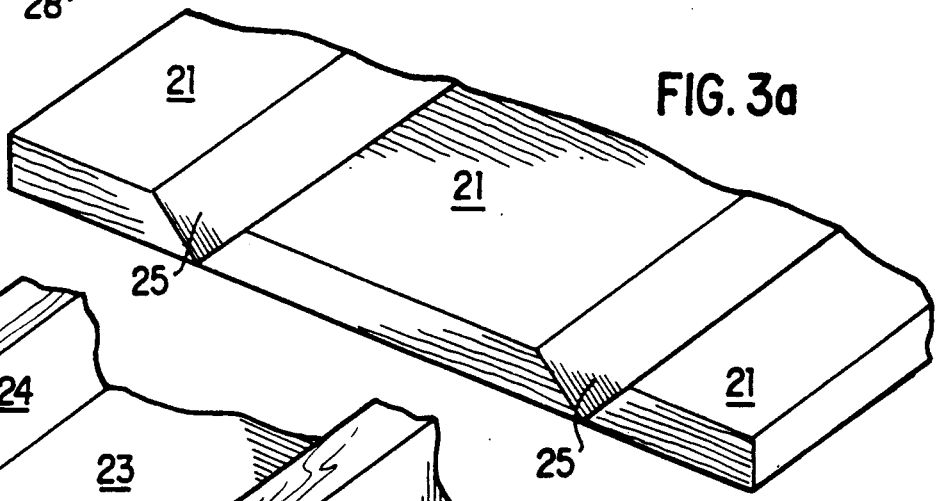
FIG. 3*a* shows a perspective view of a blank panel having V-grooves, according to one embodiment of this invention.
Figure 3B:
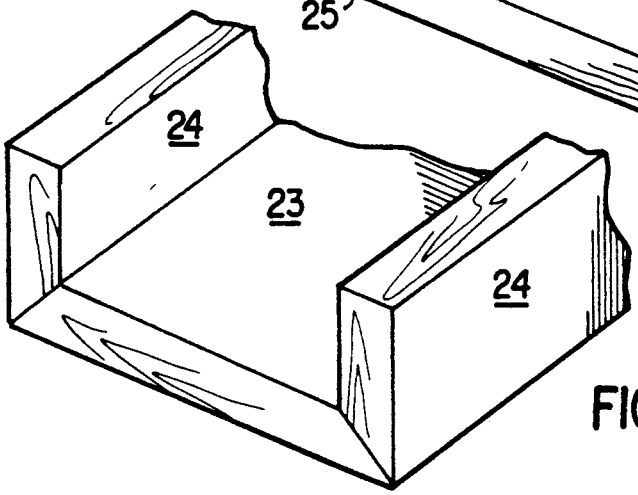
FIG. 3*b* shows a blank panel, as shown in FIG. 3*a*, folded into a C-channel.
Figure 4:
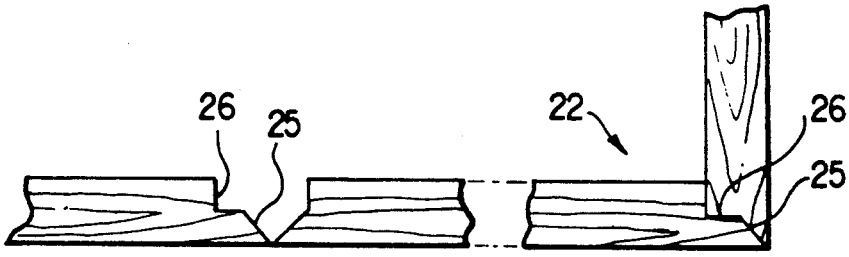
FIG. 4 shows an end view of a portion of a C-channel illustrating a groove according to another embodiment of this invention.

FIG. 3*a* shows a perspective view of the blank panel 21 and of the blank panel 21 with the V-grooves 25 and FIG. 3*b* shows a blank panel 21 glued and folded into a C-channel 22 having a web 23 and perpendicularly projecting flanges 24. FIG. 4 shows an alternate type of a V-groove 25 with a notch 26. This is done by changing the configuration of carbide or diamond coated cutting wheel which is used to cut the V-groove 25 in blank panel 21.

Figure 7:
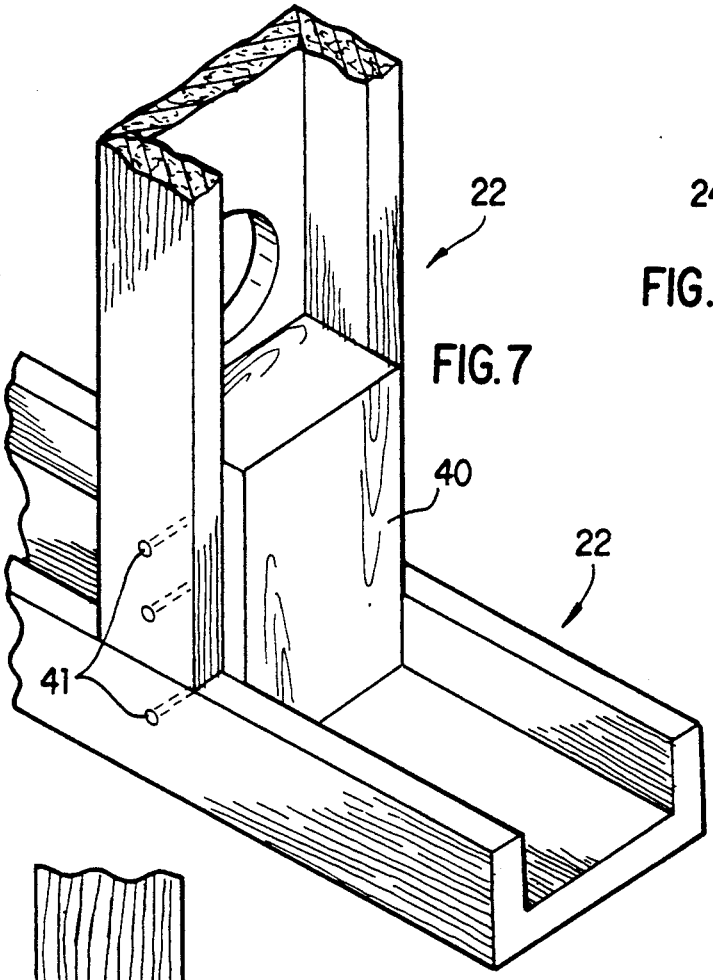
FIG. 7 shows a connection of one C-channel to another C-channel using a splice block according to one embodiment of this invention.
Figure 6:
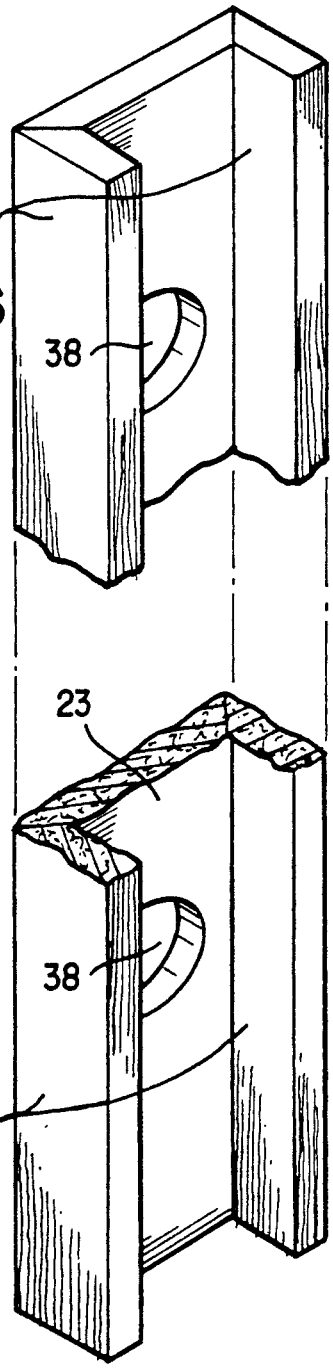
FIG. 6 shows an isometric view of a C-channel having pre-drilled holes.
Figure 5:
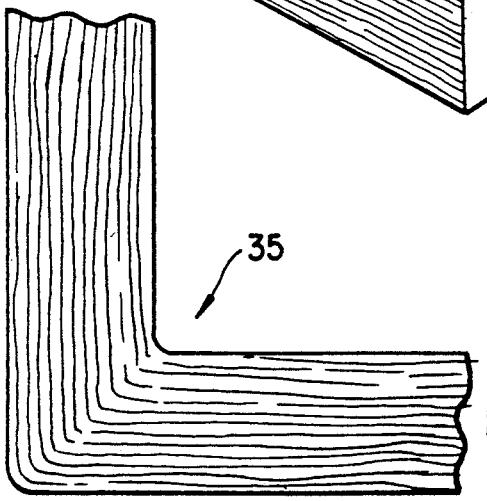
FIG. 5 shows an end view of a one-piece corner configuration according to one embodiment of this invention.

FIG. 5 shows one embodiment of the oriented strand board (OSB) or wood particles being formed at the mill into a one-piece corner configuration 35. FIG. 6 shows an isometric cut-away view of a vertical wood C-channel 22 as described above and FIG. 6 shows pre-drilled holes 38 which are fabricated when the C-channel 22 is manufactured so that in the field, electricians and plumbers could wire and put appropriately sized conduits or pipes through the wall without any field drilling or other fabrication. FIG. 7 shows a connection of one C-channel 22 to another C-channel 22 through the use of a simple splice block 40 which is secured, such as with either nails 41 or screws, from the sides. Such connection provides a very rigid, solid connection, much more solid than a typical lumber construction using nails through a 2×4 plate into the bottom of 2×4. There is a lot less movement with a connection of this invention as described above.

Figure 8:
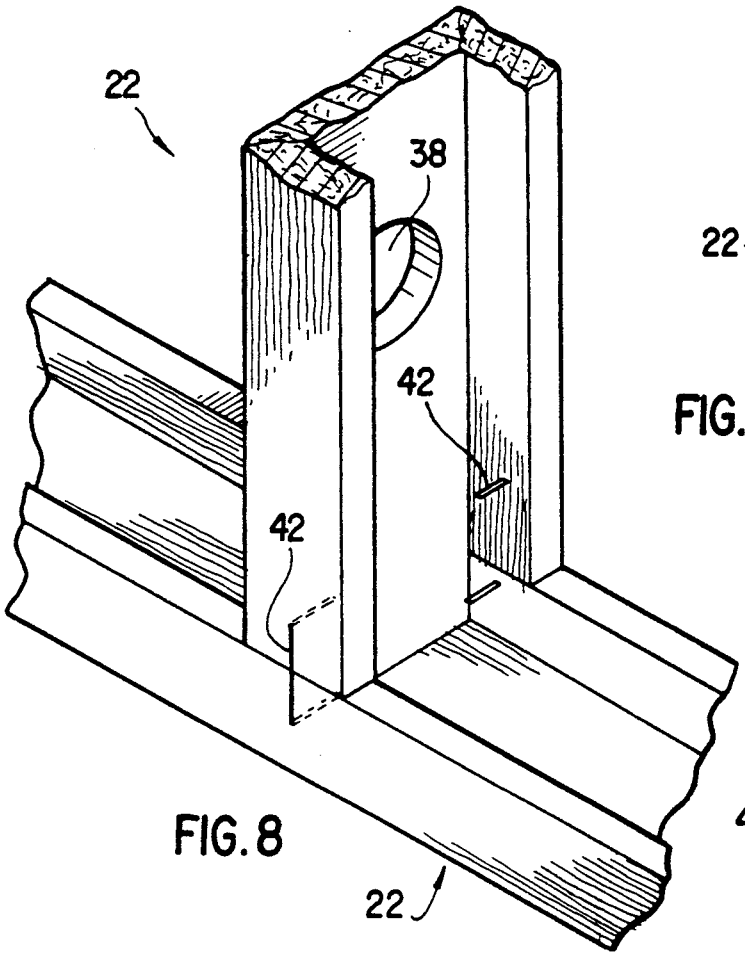
FIG. 8 shows an isometric view of one C-channel connected to another C-channel according to another embodiment of this invention.
Figure 9:
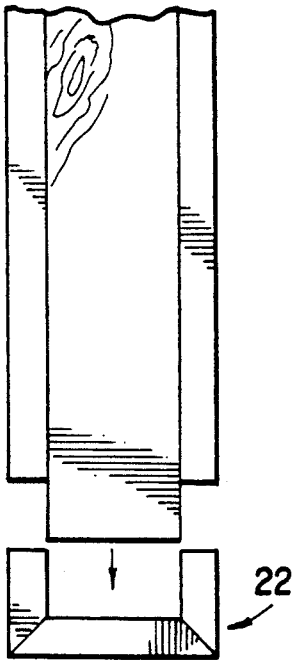
FIG. 9 shows an exploded end view of the connection as shown in FIG. 8.
Figure 10:
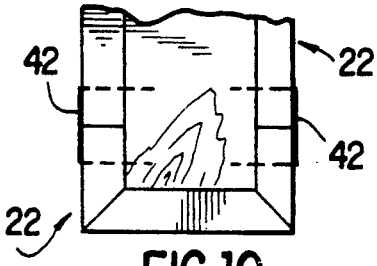
FIG. 10 shows an end view of the connection as shown in FIG. 8.

FIG. 8 shows a notch and staple connection where the flanges are notched at the bottom and the top of C-channel 22 and fit into the C-channel 22 which is used as a plate. When the fit is tight and square, a fastener or staple 42 is installed or fired across the joint into the stud and into the plate C-channel 22 on both sides. This securement provides a very economical and rigid form of connection, especially for panelized or manufactured housing operation. The cost effectiveness of notching is about the same as that of using the splice block 40. FIG. 9 shows an exploded end view of the connection as shown in FIG. 8 and FIG. 10 shows an end view of the connection as shown in FIG. 8.

Figure 11:
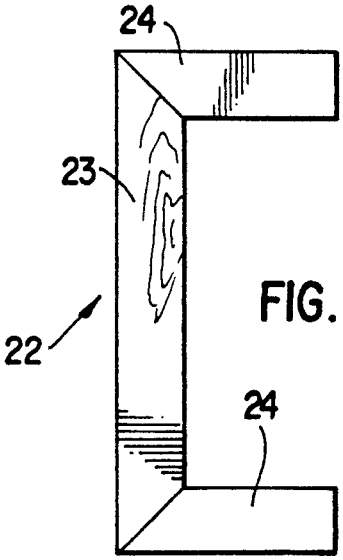
FIG. 11 shows an end view of a C-channel according to one embodiment of this invention.

FIG. 11 shows an end view of a typical C-channel 22 which can have different sizes such as 2×2 nominal size which is actually 1 ½×1 ½ inches. Another nominal size is 2×3 which is actually 1 ½×2 ½ inches. Another nominal size is 2×4, the most common of all framing lumber which is actually 1 ½×3 ½ inches. A little heavier wall stud or lightweight ceiling joist is a nominal size 2×6 which is actually 1 ½×5 ½ inches.

Figure 12:
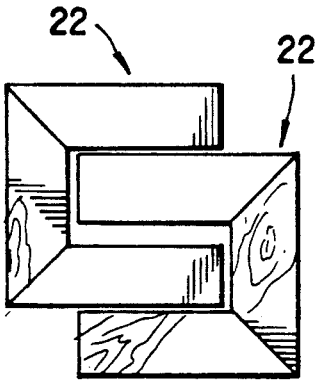
FIG. 12 shows an end view of two nested C-channels according to one embodiment of this invention.

FIG. 12 shows an end view of two nested C-channels 22 and as compared to a standard dimension lumber both in a 2×2 size and a 2×6 size, there is approximately ⅓ less volume required for shipping and storage with comparably dimensioned C-channels 22 according to this invention. The lesser volume and the lighter weight of the C-channels 22 would allow shipping approximately 50% more pieces per truckload and would result in quite a freight costs saving.

Figure 13A:
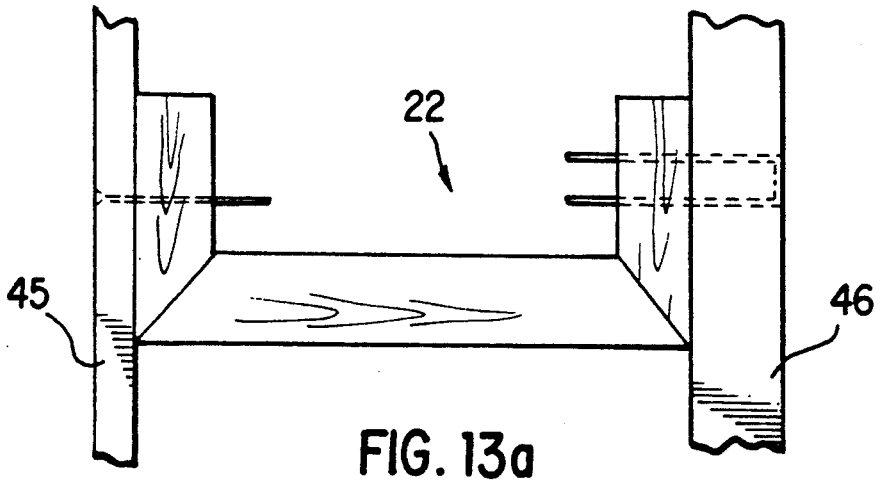
FIGS. 13*a*–13*c* show 3 different embodiments of end views of panel materials attached to C-channels.
Figure 13B:
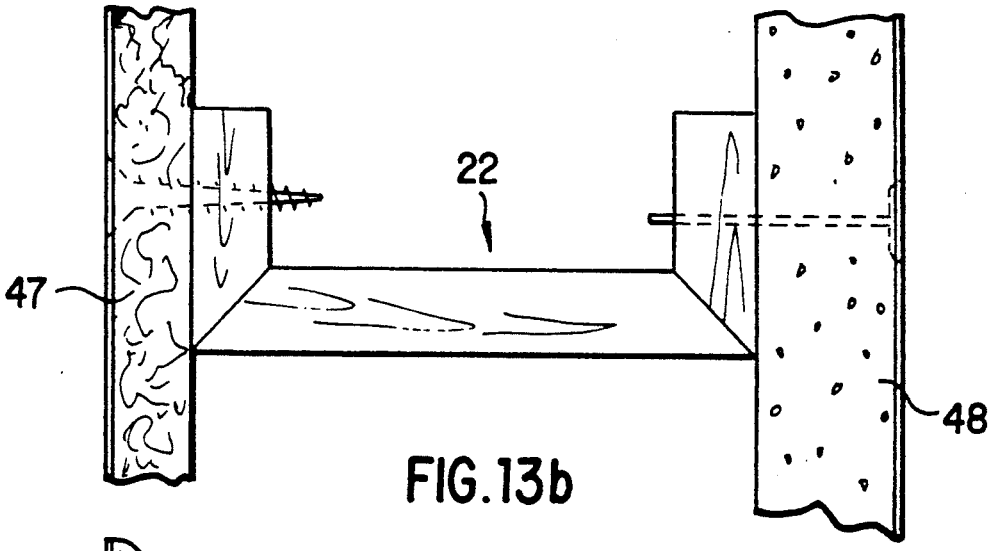
Figure 13C:
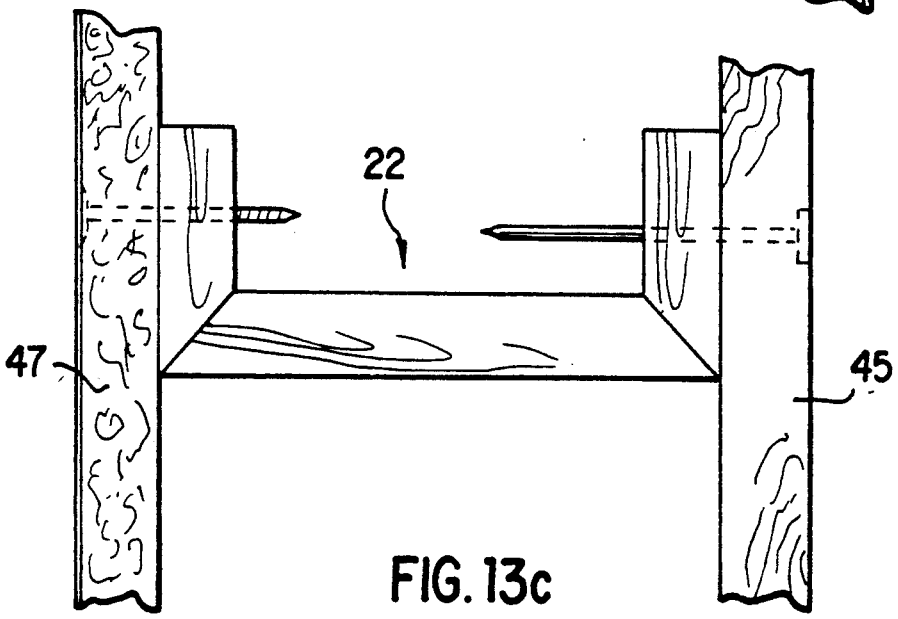
Figure 14A:
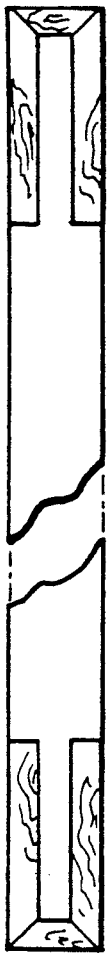
FIGS. 14*a*–14*d* show end views of combinations of C-channels to form heavier structural elements.
Figure 14B:
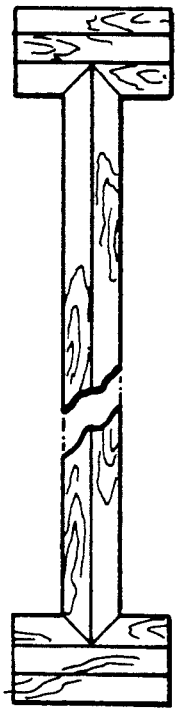
Figure 14C:
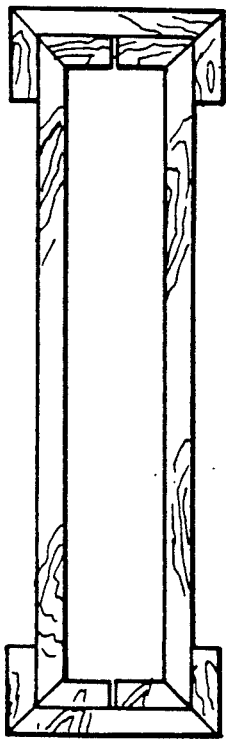
Figure 14D:
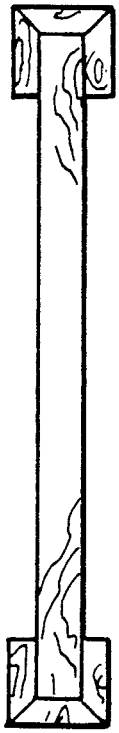

FIGS. 13*a*–13*c* show embodiments of end views of panel materials attached to the C-channels 22. FIG. 13*a* shows sheathing 45 stapled at the left and on the right, the interior of a wall, paneling 46 is secured to the C-channel 22, for example, with a finish nail. FIG. 13*b* shows rigid foam insulation 47 secured at the left. It serves as insulation as well as sheathing in many instances. On the right of FIG. 13*b* is gypsum board 48, such as ½ inch gypsum board, secured or screw attached to the C-channel 22. FIG. 13*c* shows a siding or sheathing 45 secured or nailed to the C-channel 22 on the left-hand side and gypsum board 48, such as ½ inch gypsum board, secured or nailed with a conventional ring shank dry wall nail.

FIGS. 14*a*–14*d* show several end views of a more sophisticated use of the C-channels 22 in the composition of floor joist wood I-beams and heavier structural elements. This specification does not focus upon the details of such uses of the C-channel 22 combinations but merely discloses that such arrangements and uses of C-channels 22 can be accomplished.

Figure 15:
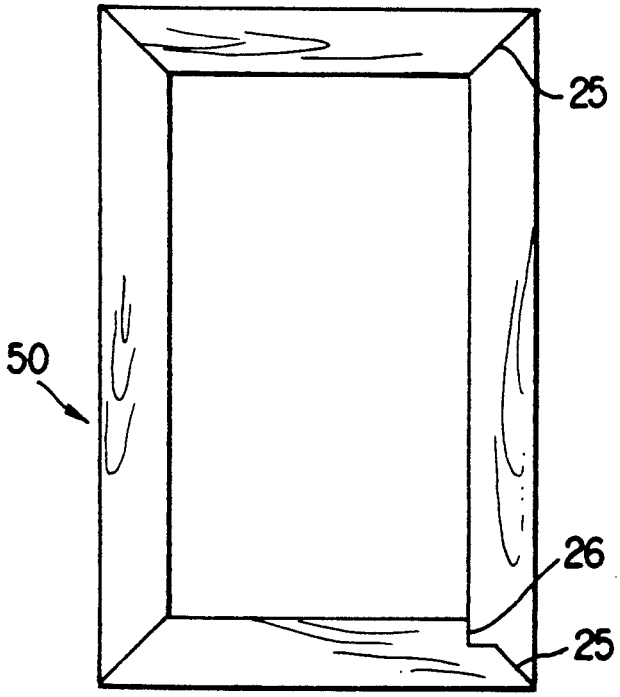
FIG. 15 shows an end view of a four-sided building construction element according to one embodiment of this invention.

FIG. 15 shows a four-sided building construction element 50. Such building construction element 50 uses the C-channel 22 of this invention and wraps it all the way around the splice block 40. Such building construction element 50 uses a larger blank panel 21 and two additional V-grooves 25. Such building construction element 50 provides more rigidity per given cross section dimension and four sides for better securing methods which are known in the art. Such elements 50 may be used in the furniture business in place of four-sided square lumber. Element 50 could be fabricated in any suitable size with any suitable thickness of panel material starting from about ¼ inch up to about 1 inch.

While in the foregoing specification this invention has been described in relation to certain preferred embodiments and many details have been set forth for the purpose of illustration, it will be apparent to those skilled in the art that the invention is susceptible to additional embodiments and that certain details described herein can be varied considerably without departing from the basic principles of the invention.

I claim:

1. A frame for supporting wall, floor or ceiling panels in a building construction, said frame including a plurality of C-channel construction members of wood composite construction, each member having a web and two flanges, said frame including at least one C-channel base member and at least one C-channel intersecting member wherein the flanges of the base member abut the flanges of said intersecting member;

and a splice element received between said abutting flanges to rigidly connect said base and intersecting members.

2. A frame according to claim 1 wherein said wood composite construction further comprises wafers and strands of wood fiber pressure glued together.

3. A frame according to claim 1 wherein said wood composite construction further comprises oriented strand board material.

4. A frame according to claim 1 wherein said web and said flanges of each said C-channel base member are formed into a one-piece member.

5. A frame according to claim 1 wherein said web and said flanges of each said C-channel intersecting member are formed into a one-piece member.

6. A frame for supporting wall, floor or ceiling panels in a building construction, said,frame including a plurality of C-channel construction members of wood composite construction, each member having a web and two flanges, said frame including at least one C-channel base member and at least one C-channel intersecting member wherein the flanges of the base member abut the flanges of said intersecting member;

and a fastener having one end secured with respect to an outer surface of said at least one C-channel base member and an opposite end secured with respect to an outer surface of said C-channel intersecting member.

7. A frame according to claim 6 wherein said wood composite construction further comprises wafers and strands of wood fiber pressure glued together.

8. A frame according to claim 6 wherein said wood composite construction further comprises oriented strand board material.

9. A frame according to claim 6 wherein said web and said flanges of each said C-channel base member are formed into a one-piece member.

10. A frame according to claim 6 wherein said web and said flanges of each said C-channel intersecting member are formed into a one-piece member.

11. A frame according to claim 6 wherein each said C-channel intersecting member further comprises a web extension section positioned between said two flanges of said C-channel base member.

12. A frame according to claim 6 wherein said fastener is a staple, a first prong of said staple pierces said outer surface of said C-channel base member, and a second prong of said staple pierces said outer surface of said C-channel intersecting member.

* * * * *